US006065168A

United States Patent [19]

Damron

[11] Patent Number: 6,065,168

[45] Date of Patent: May 23, 2000

[54] INDEPENDENT SUSPENSION MATTRESS

[76] Inventor: Kenneth Jonathan Damron, 2278 Greenbriar Ct., Grand Junction, Colo. 81503

[21] Appl. No.: 09/195,837

[22] Filed: Nov. 19, 1998

[51] Int. Cl.[7] ..... A47C 23/04

[52] U.S. Cl. ..... 5/716; 721/727

[58] Field of Search ..... 5/716, 721, 727, 5/654.1

[56] References Cited

U.S. PATENT DOCUMENTS

| | | | |
|---|---|---|---|
| 2,629,111 | 2/1953 | Korney | 5/716 |
| 2,651,788 | 9/1953 | Forwood | 5/716 |
| 2,853,721 | 9/1958 | Koenigsberg | 5/716 |
| 3,089,154 | 5/1963 | Boyles | 5/716 |
| 3,092,849 | 6/1963 | Clifton | 5/716 |
| 3,456,271 | 7/1969 | Janapol | 5/716 |
| 3,865,675 | 2/1975 | Arnold | 5/721 |
| 3,995,337 | 12/1976 | Gershaw | 5/716 |
| 4,213,214 | 7/1980 | Gilhooly | 5/716 |

*Primary Examiner*—Alexander Grosz
*Attorney, Agent, or Firm*—Edwin L. Hartz

[57] ABSTRACT

An independent suspension mattress has an opening in the middle section of the innerspring unit that is long enough along the longitudinal center to provide independence of the sleeping sections on the two sides of the opening. In a coil spring unit the coils adjacent to the centerline and the middle section are untied.

16 Claims, 7 Drawing Sheets

INDEPENDENT SUSPENSION MATTRESS

BACKGROUND OF THE INVENTION

1). Field of the Invention

This invention relates to the method of construction and to the resulting innerspring mattress having independent suspension when used by two people.

2). Prior Art

There have been attempts to create an innerspring mattress with independent suspension for two people. One such attempt is disclosed in U.S. Pat. No. 2,853,721 granted on Sep. 30, 1958, to M. Koenigsberg. It is stated in the Koenigsberg patent that ". . . in double mattresses it is desirable to construct the mattress so that a person lying on one side thereof will not cause the entire mattress to sag to the discomfort of a person lying on the other side." [Col. 1 lines 29–33] The solution proposed by Koenigsberg is in effect two separate spring units within a common padding and ticking or cover. In a first embodiment two effectively separate spring units are bordered by independent coil springs as shown in FIGS. 5–7 and 13 and 14 of the drawings of the Koenigsberg patent. A pair of sleeping sections is separated by a centrally disposed row of springs. (This row may also be considered a longitudinal, i.e., head-to-toe, column of springs). The completed mattress with this spring assembly has a hard area down the middle.

A hard area down the middle of the mattress also results from the spring assembly of another embodiment shown in FIGS. 10–12. In this embodiment a pair of sleeping sections is separated by one or more longitudinal column(s) or row(s) of coil springs that are centrally located. The central row of springs is enclosed by border wires to further separate the sleeping sections.

In both embodiments of Koenigsberg, the two sleeping sections essentially extend the longitudinal length of the mattress.

U.S. Pat. No. 2,629,111 issued to R. F. Korney on Feb. 24, 1953 discloses another approach to independent suspension. However, a hard area in the center and running longitudinal is also present in the Korney design. Effectively, two separate spring units with border wire around the periphery at the top and bottom are placed side-by-side. Each spring assembly has its own padding and complete spring unit.

Another independent suspension mattress that employs side-by-side spring assemblies, similar to that of the Korney patent, is disclosed in U.S. Pat. No. 2,651,788, granted D. F. Forwood on Sep. 18, 1953. Each spring assembly has its own resilient pad and its own padded cover. Again, a central hard area running longitudinally results.

SUMMARY OF THE INVENTION

The mattress of this invention has a unitary spring system wherein an opening along the longitudinal center is created in the spring unit. The opening is in the middle section of the spring unit and has sufficient length to permit the spring unit on one side of the opening to function independently of the spring unit on the other side of the opening. Additionally, the length of the opening is limited to avoid too much looseness in the springs along the opening which could cause touching across the opening and clicking. For the standard mattresses having a length of 80 inches or 84 inches, the length of the opening or separation is between approximately 36 inches and 48 inches, with a preferred length of 39 inches.

Objects, features and advantages of this invention will become apparent from a consideration of the description, the appended claims and the accompanying drawing.

DESCRIPTION OF PREFERRED EMBODIMENT

Figure 1:
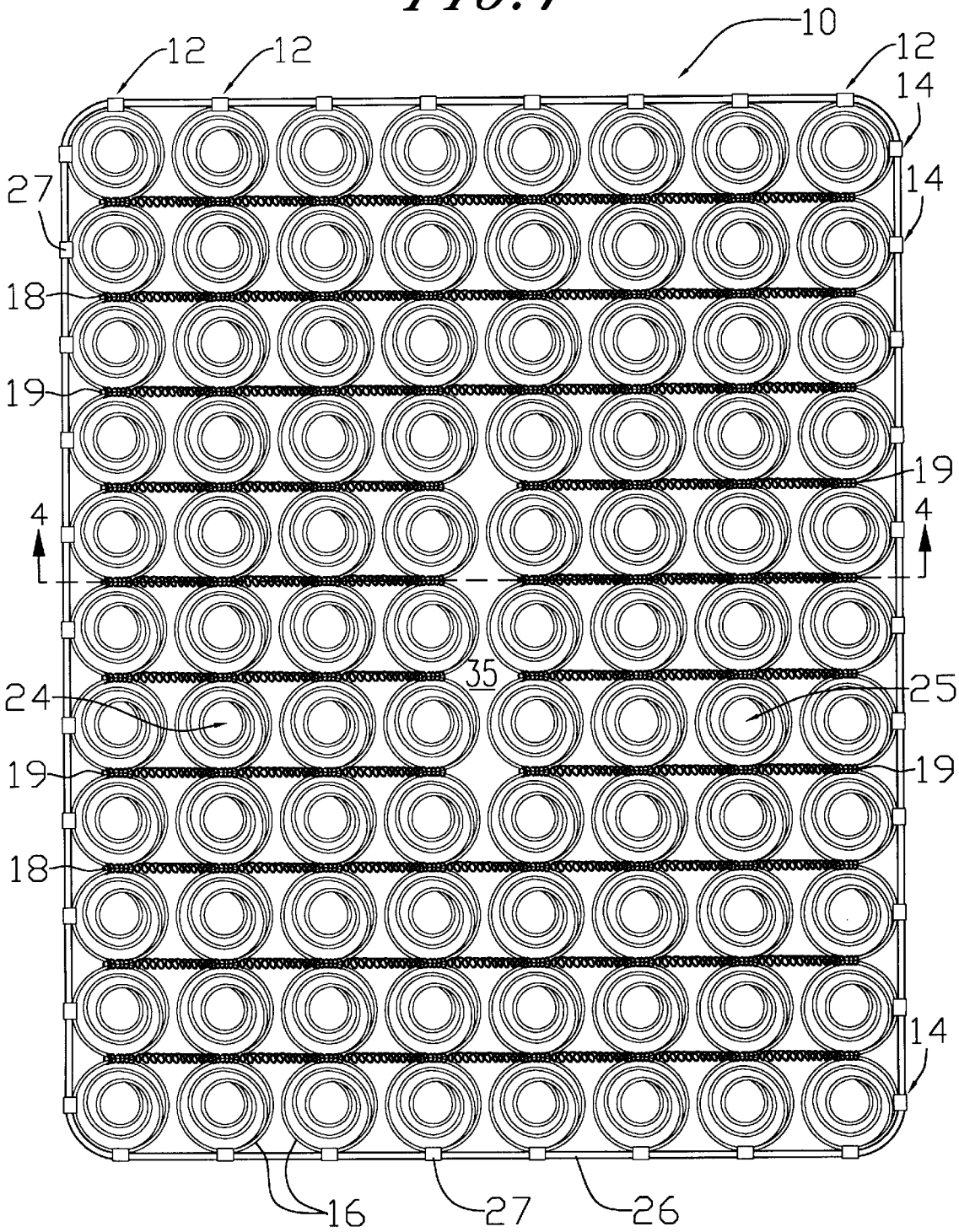
FIG. 1 is a top plan view of an illustrative spring unit for an independent suspension mattress in accordance with this invention.
Figure 2:
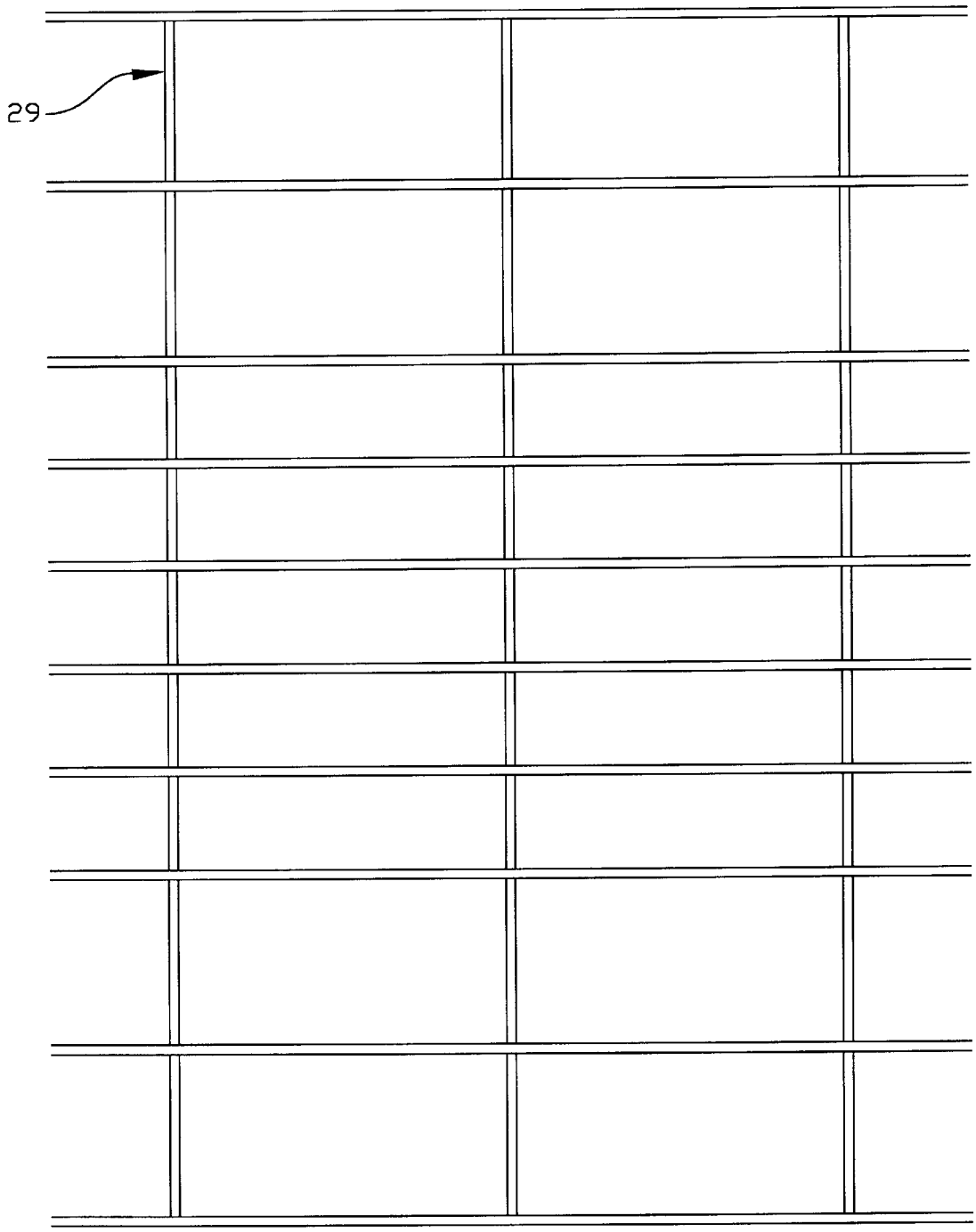
FIG. 2 is a top plan view of sisal cordage that is placed on top of the spring unit of FIG. 1 in accordance with this invention.
Figure 3:
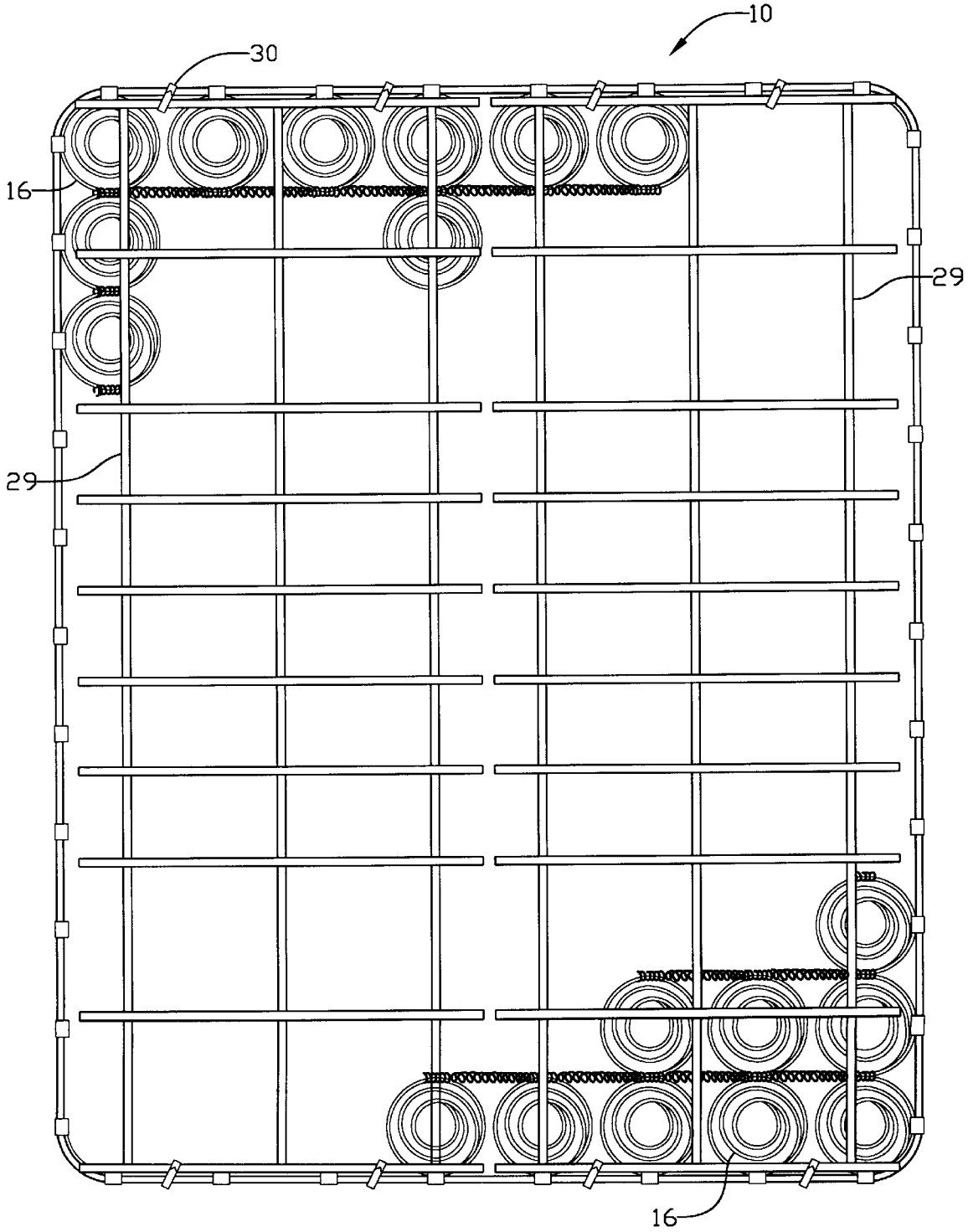
FIG. 3 is a top plan view of a sisal cordage on each side of the longitudinal separation of coil springs shown schematically in accordance with this invention.

Most innerspring mattresses have a spring unit consisting of a matrix of coil springs held together in some fashion. One common way of joining coil springs is disclosed in U.S. Pat. No. 3,089,154 granted T. C. Boyles on May 14, 1963. Helicoil wire, also known as snake wire, extends across the width of the spring unit. The matrix of columns and rows of coil springs form the inner springs of the mattress. The coil springs in one column typically do not touch the coil springs in the adjacent column, while the coil springs in one row touch the coil springs in the adjacent row.

Another way of joining the coil springs in the matrix to form a spring unit is disclosed in the above referenced Koenigsberg patent. A coil spring inside the outermost column and row has a short spring attaching it to one of the four coil springs that are in the adjacent row and one column to the right or left. There are four such springs for each inner coil spring that is coupled to the diagonally disposed coil spring.

This invention is applicable to many configurations of spring units, including those of the Boyles patent and of the Koenigsberg patent. However, it will be illustrated using helical coil (helicoil) wire normally extending across the width of the spring unit as shown in FIG. 1 of the drawing and with coil springs.

The spring unit 10 of FIG. 1 is schematic in form as it has a matrix of eight columns 12 and eleven rows 14 of coil springs 16 for a total of 88 coil springs.

In commercial spring units the number of coil springs is generally stated as a number for a full-size mattress. This is the base number that is used in determining the number of coil springs in the other sizes, such as queen, California king, and Eastern king. For example, a typical size has 336 coils per full size and 416 coils for a queen, 486 coils for a California king and 520 coils for an Eastern king. Another one that is often used has 368 coils per full size.

The spring unit 10 of FIG. 1 is representative of any spring unit for a mattress designed to accommodate two people. Such mattresses typically have an even number of columns 12.

This invention relates to the method of manufacture as well as the various resulting independent suspension mattresses.

The spring unit 10 may be manufactured with all helicoil wires 18 extending across the entire width of the unit or only part way in the middle section. If the spring unit 10 has the helicoil wires 18 extending across the entire width then a first step in the method is to cut a plurality of the helicoil wires in the middle section. Shorter helicoil wire 19 results. Sufficient helicoil wires 18 are cut or helicoil wires 19 are present in the middle section to provide two independent sleeping sections 24 and 25.

For the standard mattress having a length of 80 inches or 84 inches, the length of the separation or opening between the two sleeping sections 24 and 25 is between approximately 36 inches and 48 inches. The middle section of an 80-inch mattress is approximately 45% to 60% of the total length. The remaining 40% to 55% is split between the head section and the foot section. The middle section of an 84-inch mattress is approximately 43% to 57% with the balance split between the head section and the foot section.

A mattress employing a coil spring unit 10 having three-inch coil springs 16 has an opening of 39 inches between helicoil wires 18. This distance provides good independent movement of one side relative to the other and does not create such independence or looseness that the coil springs touch across the center line to cause clicking.

The helicoil wires 18 are cut on the top 20 of the spring unit 10 and on the bottom 22 to create the separation or opening 35. The mattress with this spring unit may be turned over without affecting the independence of the sleeping sections 24 and 25. Additionally, the spring unit 10 preferably has an even number of columns 12 so that the resulting mattress may be rotated as well as turned over without changing the characteristics of the two sides of the bed.

The spring unit 10 has some element or elements around the periphery to provide rigidity to the resulting mattress. In unit 10, border rod 26 extends around the top 20 of the spring unit 10. Another border rod 28 extends around the bottom 22 of the unit 10. The coil springs 16 adjacent to the edges of the spring unit 10 are attached to the border rods 26 and 28 by clips 27.

A sisal cordage or flexolator 29 may be attached to each side of the spring unit 10 to provide a firmer support. The sisal cordage 29 is also attached to the bottom two sides for when the mattress is turned over. The flexolator unit 29 adds rigidity and support to the sleeping sections 24 and 25. The sisal cordage is attached to the spring unit 10 by some suitable attaching means, such as hog rings 30.

The sisal cordage 29 may be omitted if the coil springs 16, helicoil wires 18, 19 and border rods 26 and 28 combine to provide a sufficiently rigid and stable spring unit.

Figure 4:
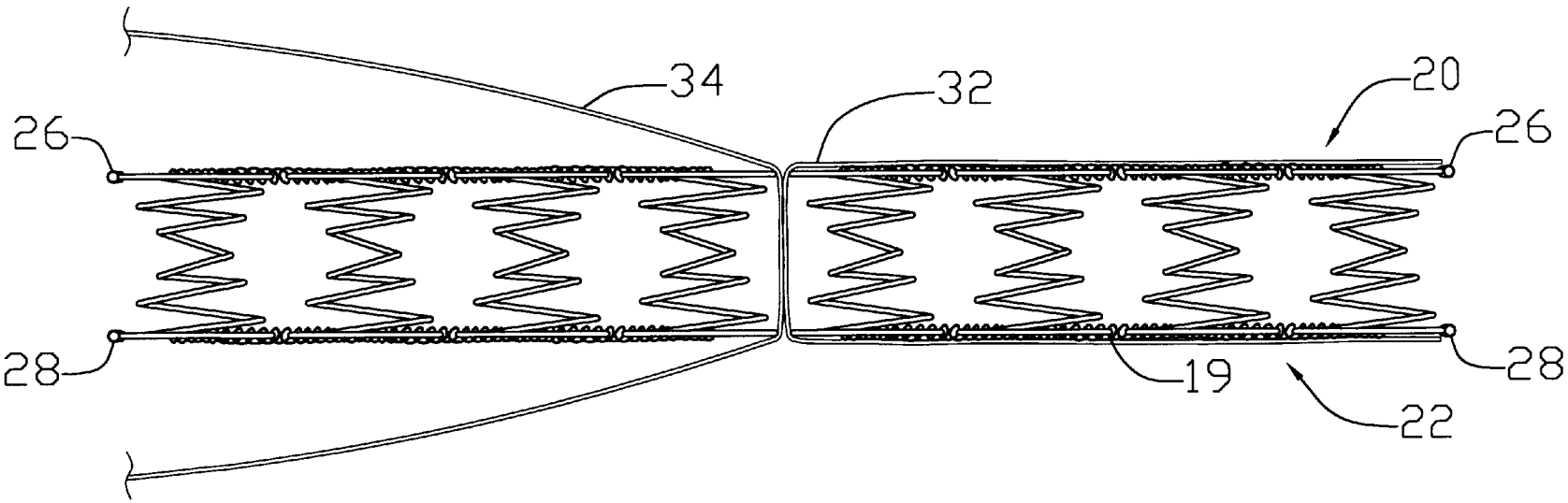
FIG. 4 is a cross-sectional view along the section lines 4—4 of FIG. 1 with padding in place on one side and with padding being put in place on the other side in accordance with this invention.
Figure 5:
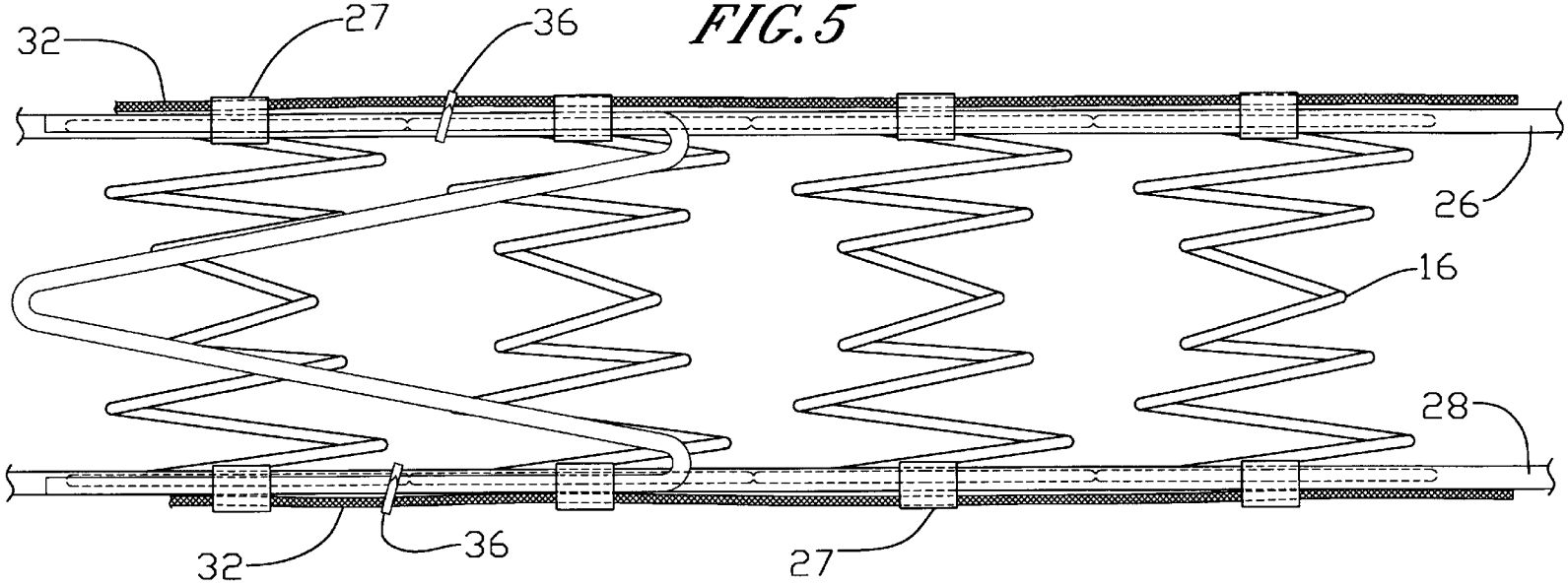
FIG. 5 is a side elevation view of the spring assembly with pads in place about the central portion in accordance with this invention.

With or without the sisal cordgage 29, the next step is the addition of padding 32 and 34 to more fully separate the untied coil springs 16 along the center line of the spring unit 10. A cross-sectional view along section line 4—4 of FIG. 1 is shown in FIG. 4. In addition to the coil springs 16, helicoil wire 19 and border rod 26 of FIG. 1, padding 32, in place, and padding 34, being put in place, is shown in FIG. 4.

Padding 32 and padding 34 has a width that is slightly narrower then the distance between the helicoil wires 18 that define the ends of the separation or opening 35 and the middle section of the spring unit 10. Thus, the preferred width of the padding is approximately 38".

The padding 32 is pulled through the opening 35 between the coil springs 16 in the middle section and folded down on the top 20 and bottom 22 of the spring unit on one side of the opening. After padding 32 is pulled sufficiently taut to remove wrinkles and to lie smoothly on the coil springs 16, the ends are attached to the border rod 26 by appropriate means, such as hog rings 36.

One end of the padding 34 is then pulled through the opening 35 and the padding 34 is positioned with the ends near the border rod 26 at the top 20 and near the border rod 28 at the bottom 22 of the spring unit 10. The padding 34 is pulled sufficiently taut to remove wrinkles and to permit the padding 34 to lie smoothly across the coil springs 16. The ends are attached to the border rod 26 by hog rings 36. After one end is attached, the other end is pulled to provide the desired tautness and smoothness of the padding 34.

Figure 6:
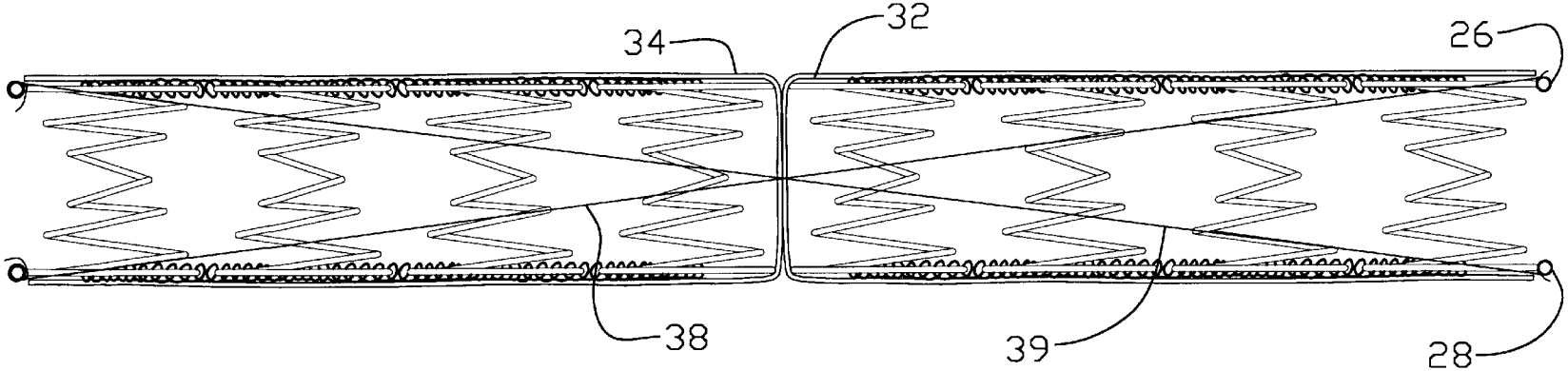
FIG. 6 is a cross-sectional view of the mattress assembly in the area of the section line 4—4 of FIG. 1 with strings to hold the separated coil springs in the central section together in accordance with this invention.

String 38 is threaded through padding 32 and 34 near the center of the spring unit 10. FIG. 6 shows the string 38 in place and is a view similar to that of FIG. 4 along the section line 4—4 of FIG. 1 with paddings 32 and 34 in place.

A long needle (not shown) is pushed through the padding 32 and 34, approximately equadistant from the top 20 and bottom 22 of the spring unit 10. One string 38 is attached to the needle and is pulled across the width of the spring unit 10 as the needle is withdrawn. One end of the first string 38 is attached to the border rod 26 at the top 20 and to the border rod 28 on the bottom 22. A second string 39 is similarly put in place and one end is tied to rod 26 at the top and the other end is tied to rod 28 at the bottom, so that the strings cross-cross when in place. The strings 38 and 39 near the middle of the middle section assist in keeping the two sleeping sections 24 and 25 together.

Figure 7:
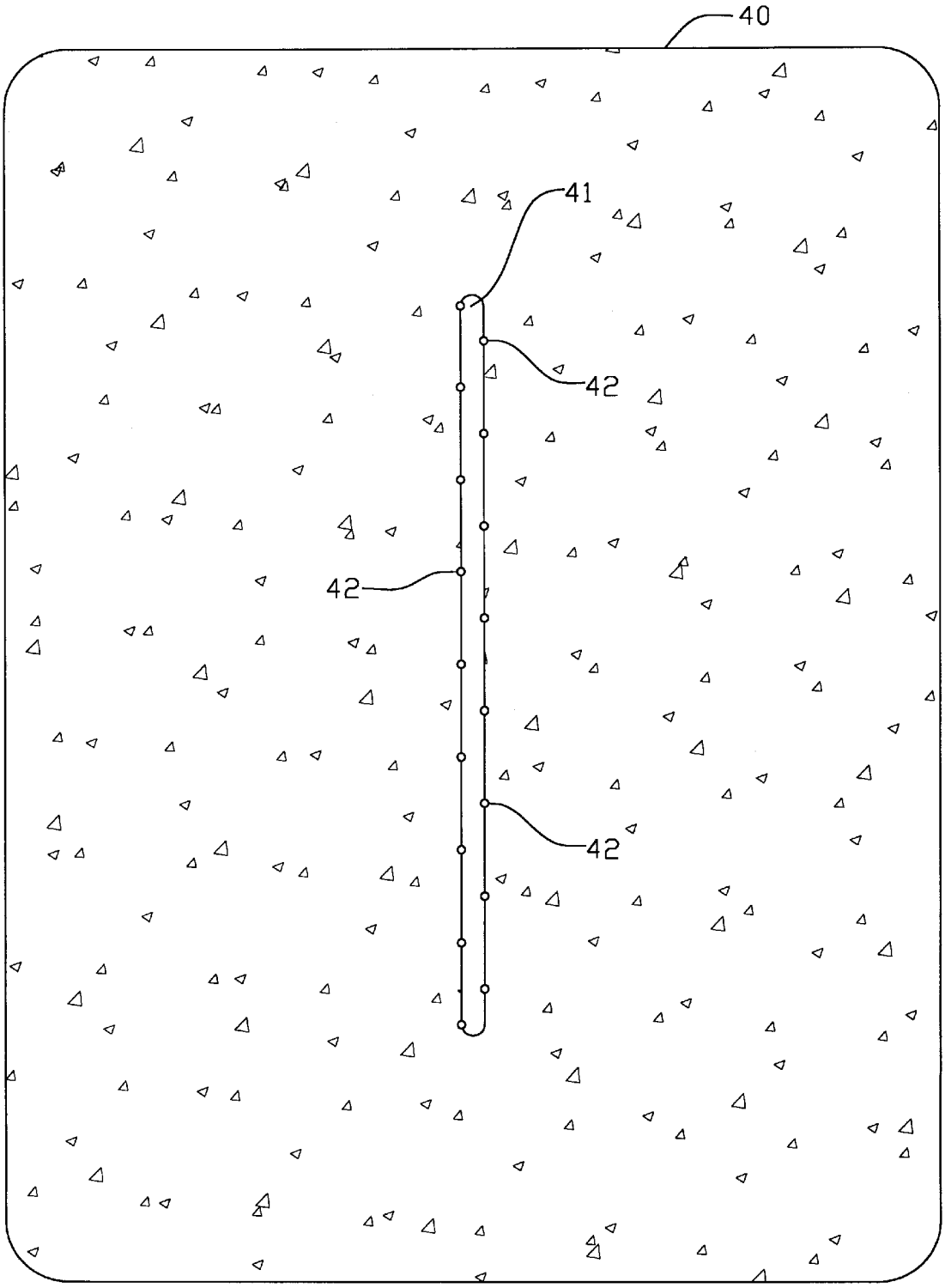
FIG. 7 is a top plan view of the mattress assembly with a full pad that is longitudinally slit and attached in the central area above the untied coil springs in accordance with this invention.
Figure 8:
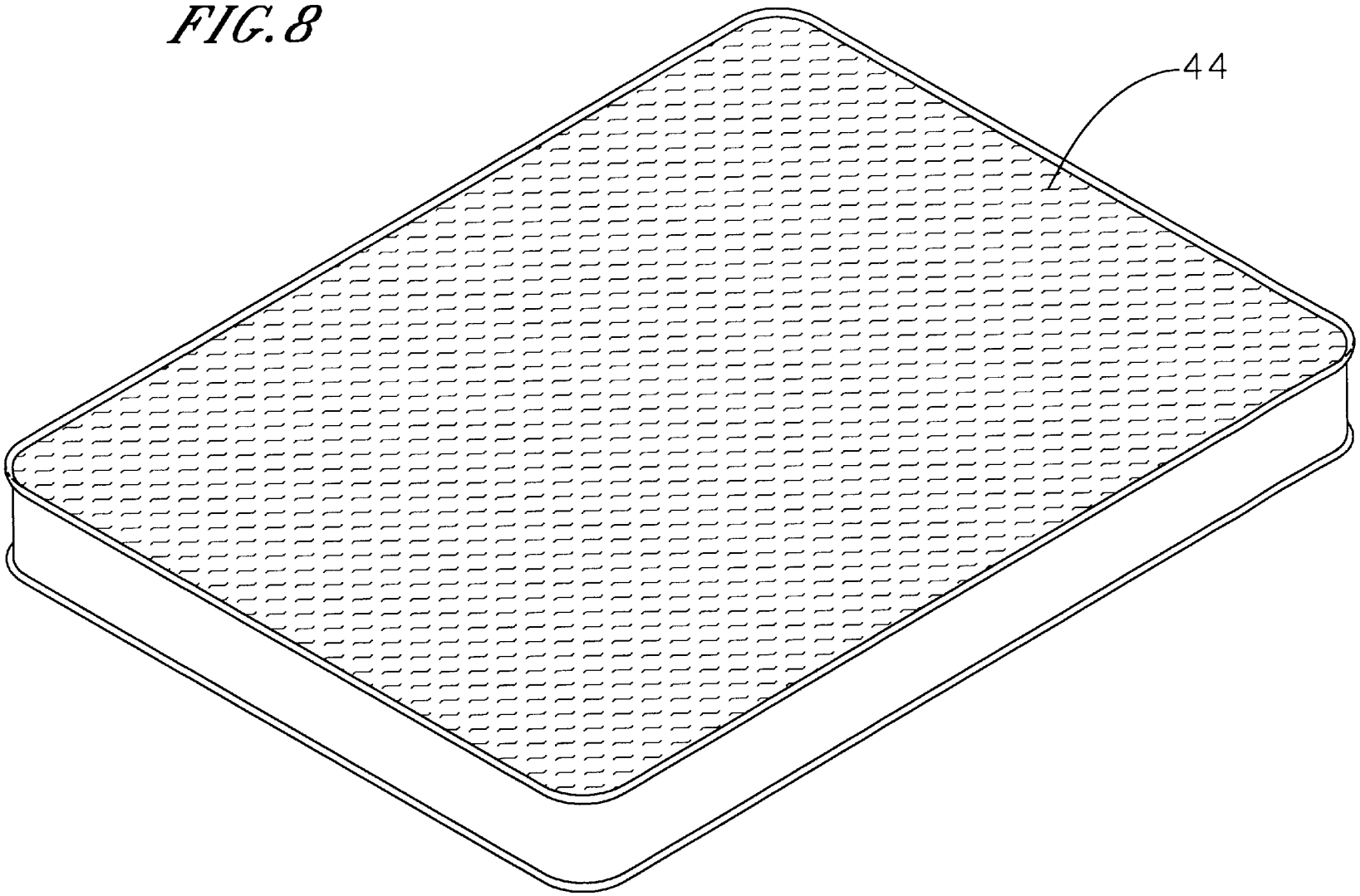
FIG. 8 is a perspective view of the completed mattress in accordance with this invention.

A full-size pad 40 is placed on the top of the spring unit 10 and is attached to the border rod 26 around the edges. A slit 41, along the longitudinal centerline, is cut in the padding of the spring unit 20 above the opening 35 between the coil springs 16 as shown in FIG. 7.

The sides of the slit 41 are attached to the coil springs 16 bordering the opening 35 by attaching means such as hog rings 42.

A full-size pad 40 is attached to both the top 20 and to the bottom 22 of the spring unit 10. Also the slit 41 is cut in both pads and the edges thereof are tied down.

The last step in the manufacturing is to add a cover 44 to encase the spring assembly of spring unit 10, optional sisal cordage 29, padding 32 and 34 and top and bottom full-size padding 40.

It is understood that the spring unit 10 with columns of coil springs that touch, with spacing there-between in the rows, and helical coil wire extending across the width of the unit is only illustrative. The invention is equally applicable to other configurations of spring units such as the one where the coil springs do not touch adjacent coil springs and are tied to the diagonally adjacent springs with short helical wire or springs. Sufficient short springs would be removed along the longitudinal centerline to provide the desired independence of the coil springs in the middle section of the mattress, using this spring unit. Although preferred embodiments of the independent suspension mattress have been shown and described above, the invention is not limited to these specific embodiments, but rather the scope of the invention is to be determined as claimed.

What is claimed is:

1. An independent suspension mattress comprising a unitary spring unit having a longitudinal opening in the middle section of the spring unit along the centerline of the spring unit.

2. An independent suspension mattress in accordance with claim 1 wherein the mattress has an overall length of 80 inches and the length of the opening in the spring unit is between approximately 45% and 60% of the length of the mattress.

3. An independent suspension mattress in accordance with claim 2 wherein the longitudinal length of the opening is between 38 inches and 40 inches.

4. An independent suspension mattress in accordance with claim 1 wherein the mattress has an overall length of 84 inches and the length of the opening in the spring unit is between approximately 43% and 57% of the length of the mattress.

5. An independent suspension mattress in accordance with claim 4 wherein the longitudinal length of the opening is between 38 and 40 inches.

6. An independent suspension mattress in accordance with claim 5 further comprising a first pad extending from the top edge of the middle section through the opening to the bottom edge of the middle section on one side of the opening, a second pad extending from the top edge of the middle section through the opening to the bottom edge of the middle section on the other side of the opening, means for attaching the ends of the first pad to the edges of the spring unit, and means for attaching the second pad to the edges of the spring unit.

7. An independent suspension mattress in accordance with claim 1 further comprising a first sisal cordage attached to the top of the spring unit on one side of the opening, a second sisal cordage attached to the top of the spring unit on the other side of the opening, a third sisal cordage attached to the bottom of the spring unit on one side of the opening, and a fourth sisal cordage attached to the bottom of the spring unit on the other side of the opening.

8. An independent suspension mattress in accordance with claim 1 further comprising a first pad extending from the top edge of the middle section through the opening to the bottom edge of the middle section on one side of the opening, a second pad extending from the top edge of the middle section through the opening to the bottom edge of the middle section on the other side of the opening, means for attaching the ends of the first pad to the edges of the spring unit, and means for attaching the second pad to the edges of the spring unit.

9. An independent suspension mattress in accordance with claim 8 further comprising a first string attached to the top edge on a first side of the opening near the longitudinal center of the spring unit and extending to the bottom edge of the spring unit near the longitudinal center of the spring unit on the second side of the opening, said first string attached to the bottom edge on the second side, and a second string attached to the top edge on the second side of the opening near the longitudinal center of the spring unit and extending to the bottom edge of the spring unit near the longitudinal center of the spring unit on the first side of the opening, said second string attached to the bottom edge on the first side.

10. An independent suspension mattress in accordance with claim 9 further comprising a first full-size pad attached to the top of the spring unit over the pads in the opening, a slit in the first full-size pad above the opening, means for attaching the edges of the slit to the spring unit, a second full-size pad attached to the bottom of the spring unit, a slit in the second full-size pad below the opening, and means for attaching the edges of the slit of the second pad to the spring unit.

11. An independent suspension mattress in accordance with claim 10 further comprising a cover encasing the spring unit and the pads.

12. A spring unit for an independent suspension mattress comprising a matrix of coil springs arranged in columns and rows, each coil in a column touching the adjacent coil in the column, first helical coil wires in a middle section extending from an edge to a distance less than one-half the width of the spring unit, said first helical coil wires joining touching coil springs in adjacent rows in the middle section, second helical coil wires extending from one edge across the width of the spring unit in a head section, said second helical coil wires joining touching coil springs in adjacent rows in the head section, and third helical coil wires extending from one edge across the width of the spring unit in a foot section, said third helical coil wires joining touching coil springs in adjacent rows in the foot section.

13. A spring unit in accordance with claim 12 wherein the middle section has a length between 47 percent and 60 percent of the length of the spring unit.

14. A spring unit in accordance with claim 12 wherein the middle section has a length between 36 inches and 48 inches.

15. A spring unit for an independent suspension mattress comprising a border bar, a matrix of coil springs arranged in columns and rows, a plurality of attachment springs for individually joining two diagonally adjacent coil springs, all coil springs being joined to diagonally adjacent coil springs or to a border bar by one of the attachment springs except for a selected number of the coil springs on either side of the longitudinal centerline of the spring unit to create a longitudinal opening along the centerline and to permit the springs on one side of the opening to function independently of the springs on the other side of the opening.

16. A unitary spring unit for an independent suspension mattress comprising a matrix of coil springs in columns and rows, a longitudinal opening along the longitudinal centerline whereby a plurality of coil springs on the one side of the centerline of the matrix being free to move independently of a like plurality of coil springs on the other side of the centerline of the matrix.

* * * * *